United States Patent [19]

Carr et al.

[11] 4,102,774

[45] Jul. 25, 1978

[54] SEPARATION OF SOLIDS FROM COAL LIQUIDS USING AN ADDITIVE

[75] Inventors: Norman L. Carr, Allison Park; Edgar L. McGinnis, Gibsonia, both of Pa.

[73] Assignee: Gulf Research & Development Company, Pittsburgh, Pa.

[21] Appl. No.: 784,047

[22] Filed: Apr. 4, 1977

[51] Int. Cl.[2] ..... C10G 1/00

[52] U.S. Cl. ..... 208/8; 208/10; 210/54

[58] Field of Search ..... 208/8, 10; 210/54 R

[56] References Cited

U.S. PATENT DOCUMENTS

| | | | |
|---|---|---|---|
| 2,133,280 | 10/1938 | Burk | 208/8 |
| 3,598,718 | 8/1971 | Glem et al. | 208/8 |
| 4,029,567 | 6/1977 | Farnand et al. | 208/8 |
| 4,030,893 | 6/1977 | Keller | 208/8 |

*Primary Examiner*—Delbert E. Gantz
*Assistant Examiner*—Joan Thierstein

[57] ABSTRACT

Ash-containing solids are separated from coal liquid by mixing alcohol with said coal liquid, followed by a solids-liquid separation step.

17 Claims, 1 Drawing Figure

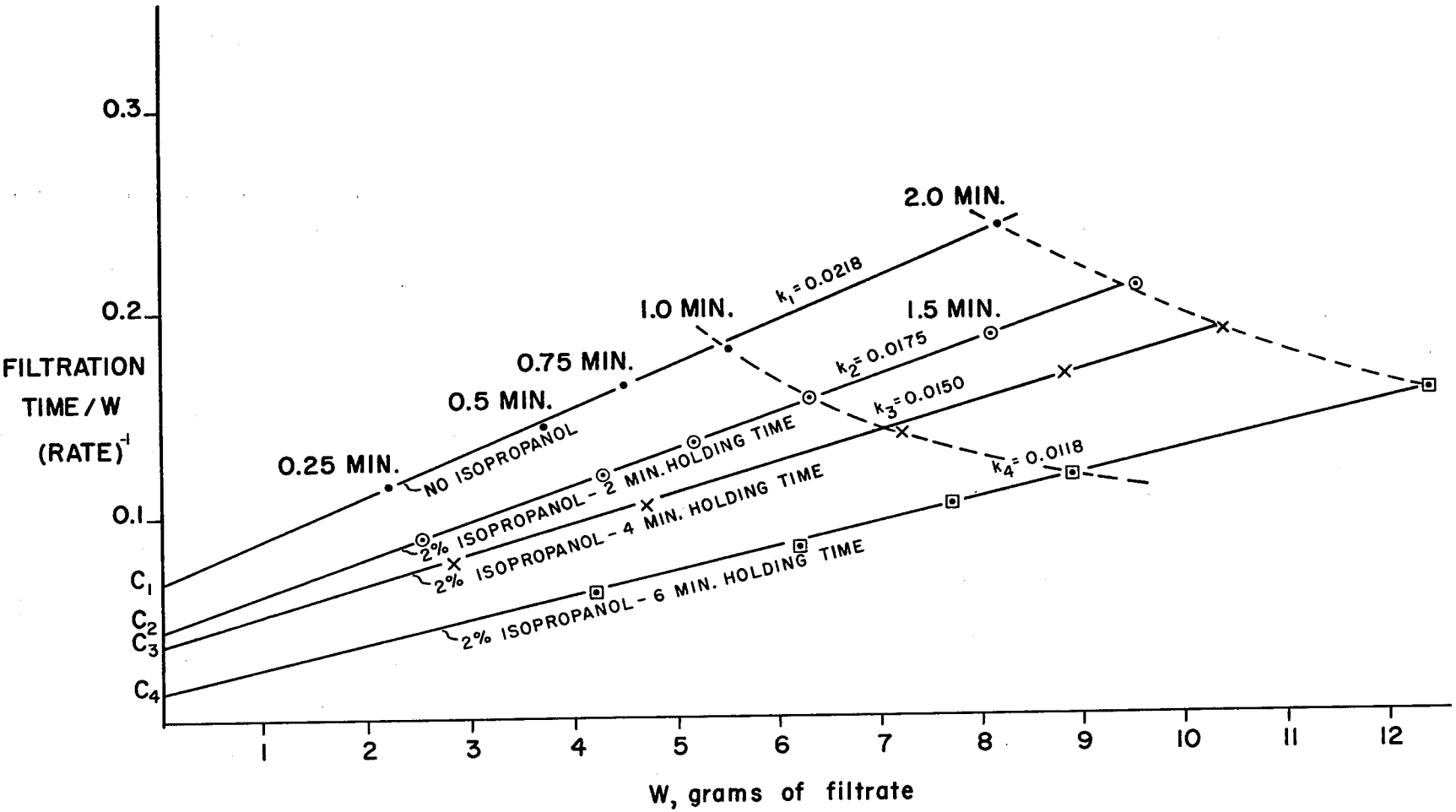
FILTRATION TIME / W (RATE)$^{-1}$
0.3
0.2
0.1
W, grams of filtrate
1
2
3
4
5
6
7
8
9
10
11
12
2.0 MIN.
1.5 MIN.
1.0 MIN.
0.75 MIN.
0.5 MIN.
0.25 MIN.
$k_1$ = 0.0218
$k_2$ = 0.0175
$k_3$ = 0.0150
$k_4$ = 0.0118
NO ISOPROPANOL
2% ISOPROPANOL - 2 MIN. HOLDING TIME
2% ISOPROPANOL - 4 MIN. HOLDING TIME
2% ISOPROPANOL - 6 MIN. HOLDING TIME
$C_1$
$C_2$
$C_3$
$C_4$

SEPARATION OF SOLIDS FROM COAL LIQUIDS USING AN ADDITIVE

This invention relates to a process for removing ash from coal liquids.

Several solvation processes are now being developed for producing both liquid and solid hydrocarbons from coal. One such process is known as the Solvent Refined Coal (SRC) process. This process is described in a number of patents, including U.S. Pat. No. 3,892,654, which is hereby incorporated by reference. The SRC process is a solvation process for producing deashed solid and liquid hydrocarbonaceous fuel from coal. In this process, crushed raw coal is slurried with a solvent comprising hydroaromatic compounds in contact with hydrogen, or carbon monoxide and water, in a first zone at a high temperature and pressure to dissolve hydrocarbonaceous fuel from coal minerals by transfer of hydrogen from the hydroaromatic solvent compounds to the hydrocarbonaceous material in the coal. The solvent is then treated with hydrogen, or carbon monoxide and water, in a second zone to replenish the hydrogen lost by the solvent in the first zone. The hydrogenenriched solvent is then recycled. The dissolved liquids contain suspended particles of ash or of ash and undissolved hydrocarbons. The suspended particles are very small, some being of submicron size, and are therefore very difficult to remove from the dissolved coal liquids. Although certain approaches have been tried to agglomerate these particles in order to increase the rate of their separation, none of the present methods for removing solids from liquefied coat has proved to be entirely successful.

It is the purpose of the present invention to treat the liquid product of a coal solvation process, such as the SRC process, containing suspended or dispersed ash-containing solids with an additive to agglomerate or otherwise affect these solids so that they can be subsequently removed from the coal liquid at a more rapid rate than would otherwise be possible. Any of the known methods for solids-liquid separation can be applied to the treated coal liquids, including filtration, settling, hydrocloning or centrifugation. If settling is employed, coal liquids treated in accordance with this invention will be relieved of their solids content without a subsequent manipulative step. However, because of the rapid rate of solids removal demonstrable by filtration, the present invention is illustrated in the following examples by the filtration method of solids separation.

A composition containing alcohol and coal liquids having suspended or dispersed solid particles comprising ash or ash and undissolved hydrocarbons has been found to be considerably more amenable to solids removal than non-alcoholic coal liquid. Primary, secondary or tertiary alcohols are effective. Aliphatic alcohols containing 2 to 10 carbon atoms can be employed. Although longer aliphatic chains may be effective, they are more expensive and needlessly increase the cost of the operation. Particularly effective alcohols include isopropyl and normal, secondary and tertiary butanol. One or more alcohols can be employed. The alcohol can be present in the coal liquid in an amount between 0.05 and 15 weight percent. Alcohol concentration ranges between 0.1 and 10 weight percent or between 0.5 or 1.0 and 6 weight percent are effective.

The alcohol employed in the present process does not perform any significant hydrogen donor or coal solvation function. For example, while butanol is a preferred alcohol of this invention, it is not an effective alcohol for purposes of coal solvation. In the present process, the alcohol is added to the coal liquefaction process after completion of the coal dissolving step, i.e. after at least about 85 or 90 weight percent of the coal has been dissolved. Furthermore, the use of alcohol in this process does not result in any significant increase in the hydrogen to carbon ratio of the coal liquid. There is no need to add alcohol to the process until after the coal dissolving and solvent hydrogenation steps are completed. Thereby, most of the alcohol is not consumed in the present process, nor is there significant conversion to another material, such as ketone, by hydrogen transfer. To prevent the alcohol from functioning as a hydrogen donor, the coal liquid to which the alcohol is added comprises a significant amount of a previously added and different hydrogen donor material, such as at least 2, 3 or 5 weight percent of hydroaromatic material, such as tetralin and homologues thereof. The hydroaromatic material present conserves the alcohol so that most of it can be recycled without hydrotreatment. Since the purpose of the alcohol is specific to solids removal, no prior removal of solids from the coal is required and the alcohol can be added to a coal liquid containing generally at least 3 or 4 weight percent of ash. The alcohol does not require any co-additive, such as a base, in order to perform its function, such as would enhance its effect if it were to perform a hydrogen donor function. Also, the alcohol functions in the present invention in the liquid phase and therefore can be used for solids-liquid separation at a temperature below its critical temperature.

It has now been discovered that the rate of solids romoval can be considerably improved by intermittent or spaced addition of increments of the alcohol to the coal liquid prior to solids removal, rather than employing a single injection. The temperature of the coal liquid should be at an elevated level prior to alcohol addition and should be between about 100° and 700° F. (30° and 371° C.), generally, between about 150° and 600° F. (66° and 316° C.), preferably, and between about 400° and 550° F. (204° and 288° C.), most preferably. Following the addition of each alcohol increment, the coal mixture should be mixed to form a homogeneous composition within the liquid phase. Between additions of alcohol increments, the coal solution can be allowed to stand at the mixing temperature from 30 seconds to 3 hours, generally, from 1 minute to 1 hour, preferably, or from 2 or 5 minutes to 30 minutes. These time intervals are also useful as a waiting period between the addition of the final alcohol increment and a filtration or other solids-removal step. Data are presented below which show that if an excessive quantity of alcohol is introduced in an individual increment, the effectiveness of the alcohol declines. However, if the same amount of alcohol is added incrementally with the stated time intervals between additions, a more beneficial effect can be realized. Since some of the alcohol can be recycled, there is very little incremental operating cost incident to the use of an enhanced quantity of alcohol.

The incremental addition of an additive to a continuous process stream can be performed by addition of one increment upstream of a second addition. The process flow time delay accounts for the required time interval.

In another mode of performing the present invention, alcohol is added incrementally to a hot, unfiltered slurry of dissolved coal and the mixture is stirred and allowed to age between increments and after the final increment. The mixture is then passed through a filter to which a diatomaceous earth precoat has previously been applied. The alcohol-containing filtrate is then distilled to recover the alcohol. The alcohol is then recycled and mixed with filter feed, together with any make-up alcohol that may be required.

Filtration tests were performed to illustrate the present invention and the data obtained were interpreted according to the following well known filtration mathematical model:

$$T/W = kW + C$$

where:

$T$ = filtration time, minutes
$W$ = weight of filtrate collected in time T, grams
$k$ = filter cake resistance parameter, minutes/grams$^2$
$C$ = precoat resistance parameter, minutes/gram and, $$T/W = (\text{rate})^{-1}$$

In the filtration tests reported below, the amount of filtrate recovered, W, was automatically recorded as a function of time, T. W and T represent the basic data obtained in the tests. Although the following variables were measured, they were held constant at desired levels in order to obtain comparative measurements: temperature, pressure drop across the filter, precoat nature and method of application, precoat thickness, and the cross-sectional area of the filter.

The W versus T data obtained were manipulated according to the above mathematical model, as illustrated in the figure. The figure is based on Example 7 and shows four curves, each representing a separate filtration. The horizontal axis shows the value for W while the vertical axis shows the value for T/W, which is the reciprocal of the filtration rate. The slope or each curve is $k$, and the intercept of each curve with the vertical axis is C.

In analyzing each curve, the parameter C is primarily a characteristic of the precoat because it is the reciprocal of the filtering rate at the beginning of the test before any significant amount of filter cake has deposited on top of the precoat. On the other hand, the slope $k$ is a parameter of the filter cake which is being deposited upon the precoat during the filtration and is therefore representative of the filtration itself exclusive of the precoat. A relatively low slope (low value for $k$) represents an advantageously low cak resistance to filtration. Stated in another manner, any reduction in $k$ represents an increase in the prevailing rate of filtration. By observing the figure, it is seen that the uppermost curve has the greatest slope (highest $k$) while the lowermost curve has the lowest slope (lowest $k$). The figure shows that after one minute of filtering time the upper curve has produced a smaller amount of filtrate than the lower curve. Viewed in another manner, although each curve indicates a lower filtration rate (i.e. a higher (rate)$^{-1}$) at the end as compared to the start of a test, a low curve slope indicates that the filtering rate has not diminished greatly during the test.

It is noted that each filtering test is performed without solvent washing of the filter cake. Since a solvent wash is intended to alter the nature of the filter cake, it would also alter the $k$ value. Many industrial filters are of the continuous rotary type wherein filtration cycles of no more than about one minute duration are continuously alternated with washing cycles wherein a wash solvent is sprayed through the filter cake to wash off the absorbed coal liquid. Therefore, all the tabulated filtering rates in the tests reported below represent the filtering operation during the first minute of filtration.

In performing the filtration tests of the following examples, a 90 mesh screen located within the filter element was precoated to a depth of 0.5 inch (1.27 cm) with diatomaceous earth. The filter element measured 1.9 cm I.D. by 3.5 cm in height and provided a surface area of 2.84 cm$^2$. The screen was supported by a sturdy grid to prevent deformation. The precoat operation was performed by pressuring a 5 weight percent suspension of the dicalite precoat material in process light oil on to the screen using a nitrogen pressure of 40 psi (2.8 Kg/cm$^2$). The precoat operation was performed at a temperature close to that of the subsequent filtering operation. The resulting porous bed of precoat material weighed about 1.2 grams. After the precoat material had been deposited, nitrogen at a pressure of about 5 psi (0.35 Kg/cm$^2$) was blown through the filter for about 1 - 2 seconds to remove traces of light oil. The light oil flowed to a container disposed on an automatic weighing balance. The light oil was weighed to insure deposition of the required quantity of precoat material. Following this operation, the light oil was discarded. The balance was linked to a recorder for later use which provided a continuous (at 5 second intervals) printed record of filtrate collected as a function of time.

A 750 gram sample of unfiltered oil (UFO) without any additive was then introduced into a separate autoclave vessel which acted as a reservoir. The UFO was maintained at a temperature of 100°-130° F. (38°-54° C.) and was continuously stirred. Stirring was accomplished using two 5 cm turbines. The shaft speed was 2,000 rpm. The filtration was begun by applying a selected 40-80 psi (2.8 - 5.6 Kg/cm$^2$) nitrogen pressure to the autoclave. The UFO flowing from the autoclave passed through a preheater coil whose residence time was controlled by the manipulation of valves and which was provided with inlet and outlet thermocouples so that the UFO reaching the filter was maintained at a uniform temperature. The UFO passed from the preheater to the filter where solid cake was formed and filtrate obtained. The filter element and filter heater were also fitted with thermocouples. As indicated above, filtrate was recovered on a balance and its weight was automatically recorded every five seconds. The filtrate was collected in a clean container.

Comparative tests to determine the effect of additives were performed using the same feed lot of UFO for which filtration data had been collected. First, the system tubing and the filter were purged of UFO with nitrogen at a pressure of about 100 psi (7 Kg/cm$^2$). The additive substance was pumped into the autoclave reservoir containing UFO. A separate filter element was fitted and precoated in the same manner as described above and the tests employing an additive in the UFO were performed in the same manner as the tests performed on the UFO without an additive. Following each filtration, the residue on the precoat material in the filter was purged with nitrogen and washed with an appropriate liquid to eliminate the UFO and additive combination.

Following is an analysis of a typical unfiltered SRC feed coal liquid employed in the tests of the following examples. Although light oil had been flashed from the oil feed to the filter in process pressure step-down stages, the filter feel oil had not experienced removal of any of its solids content prior to filtration.

Specific gravity, 60° F. (15.6° C.), 1.15
Kinematic viscosity at 210° F. (98.9° C.), 24.1 centistokes
Density at 60° F. (15.6° C.), 1.092
Ash, 4.49 weight percent
Pyridine insolubles, 6.34 weight percent
Distillation, ASTM D1160

| Percent | Temp., ° F. (° C.) at 1 atm. |
|---|---|
| 5 | 518 (270) |
| 10 | 545 (285) |
| 20 | 566 (297) |
| 30 | 602 (317) |
| 40 | 645 (341) |
| 50 | 695 (368) |
| 60 | 768 (409) |
| 70 | 909 (487) |
| 71 -recovery of all distillables occurs at 925° F. (496° C.) | |

EXAMPLE 1

A series of filtration tests was performed to illustrate the effect upon filtration of the addition of various alcohols and of phenol to a coal liquid. These tests were performed at a temperature of 500° F. (260° C.) and with a pressure drop across the filter of 40 psi (2.8 Kg/cm$^2$). Following is a tabulation of the results of these tests.

| Additive | k, (min/g$^2$) | C, (min/g) | Rate, (g/min) |
|---|---|---|---|
| None | .0256 | .22 | 3.2 |
| n-propyl alcohol, 2 wgt. % | .0245 | .12 | 4.5 |
| sec. butyl alcohol, 2 wgt. % | .0164 | .13 | 5.0 |
| ter. butyl alcohol 2 wgt. % | .0236 | .05 | 5.6 |
| iso amyl alcohol, 2 wgt. % | .0226 | .28 | 3.1 |
| phenol, 2 wgt. % | .0278 | .27 | 2.8 |

In considering the above data, it is reiterated that the filtering resistance parameter, *k*, is the best indicator of the effect of the additive upon the filtering operation because this parameter excludes all effects upon filtration inherent in the filtering system and the precoat. On the other hand, the value C is indicative of the effect of the filtering system and the precoat independently of the effect of the alcohol or phenol additives.

The above data show that the filtering resistance parameter, *k*, was reduced to various extents by all the alcohols tested, with secondary butyl alcohol effecting the greatest reduction in the resistance parameter. In contrast, phenol increased the resistance parameter, showing that it is apparently a dispersion medium, rather than an agglomerant. Therefore, the presence of phenol has an adverse effect upon filtration of coal liquids.

EXAMPLE 2

Additional filtering tests were performed at 410° F. (210° C.) and with a filter pressure drop of 80 psi (5.6 Kg/cm$^2$) to illustrate the effect of methyl alcohol and ethyl alcohol as additives to a coal liquid being filtered. The results of these tests are shown in the following table.

| Additive (2 wgt. %) | k, (min/g$^2$) | C, (min/g) | Rate, (g/min) |
|---|---|---|---|
| None | .0254 | .07 | 5.0 |
| Methyl alcohol | .0341 | .07 | 4.5 |
| None | .0376 | .06 | 4.4 |
| Ethyl alcohol | .0319 | .10 | 4.6 |

As shown in the above data, methyl alcohol has a detrimental effect upon the filtering resistance parameter, *k*, while ethyl alcohol has a slight beneficial effect.

EXAMPLE 3

Tests were performed to determine the effect of organic acids, aldehydes and ketones upon the filtration of coal liquids. The results of these tests are shown in the following table.

| Filtration at 500° F. (260° C.) and a pressure drop of 80 psi (5.6 Kg/cm$^2$) | | | |
|---|---|---|---|
| Additive (2 wgt. %) | k, (min/g$^2$) | C, (min/g) | Rate, (g/min) |
| None | .0247 | .20 | 3.5 |
| Butyl aldehyde | .0258 | .18 | 3.5 |
| None | .0263 | .32 | 2.5 |
| Acetic acid | .0245 | .35 | 2.5 |
| None | .0239 | .26 | 3.0 |
| Acetone | .0372 | .23 | 2.9 |
| Filtration at 410° F. (210° C.) and a pressure drop of 80 psi (5.6 Kg/cm$^2$) | | | |
| None | .0235 | .15 | 4.1 |
| Methyl ethyl ketone | .0256 | .17 | 3.9 |

As shown in the above data, butyl aldehyde, methyl ethyl ketone and acetic acid all exhibited an insignificant effect upon the resistance parameter, *k*. Acetone exhibited a slightly detrimental effect. The use of acids would not be desirable in an industrial process because of their corrosive nature.

EXAMPLE 4

Tests were performed to determine the effect of the amount of isopropanol additive upon the filtration of coal liquids. These tests were performed at 500° F. (260° C.) and at a pressure drop of 40 psi (2.8 Kg/cm$^2$). The results of these tests are shown in the following table.

| Additive and concentration, weight percent | k, (min/g$^2$) | Rate, (g/min) |
|---|---|---|
| None | .0192 | 5.6 |
| Isopropanol, 1% | .0119 | 7.3 |
| Isopropanol, 2% | .0065 | 8.6 |
| Isopropanol, 2.7% | .0086 | 9.2 |

The above data show a progressive reduction in the resistance parameter, *k*, as the amount of isopropanol is incrementally increased from 0 to 1 to 2 percent, respectively. However, the advantage at 2.7 percent is lower than that at 2 percent, indicating that an amount of alcohol beyond a critical level in a single injection decreases the beneficial effect obtainable.

EXAMPLE 5

In all the tests of the above examples a single additive injection was employed. However, the tests of the present example illustrate the effect of holding time and incremental addition of secondary and tertiary butyl alcohol. In these tests, the additive was added to a coal liquid feed maintained at a 120° F. (49° C.) holding temperature. The filtering tests were performed at 500° F. (260° C.) and 80 psi (5.6 Kg/cm$^2$) and included a holding time of two minutes at 500° F. (260° C.). The results of these tests are shown in the following table.

| Additive and Concentration, wgt. percent | k,(min/g$^2$) | C, (min/g) | Rate, (g/min) | Elapsed time at 120° F. (49° C.) between addition of additive and filtration, min. |
|---|---|---|---|---|
| None | .0534 | .06 | 3.8 | — |
| sec. butyl alcohol-2% | .0309 | .29 | 2.8 | 1 |
| sec. butyl alcohol-2% | .0301 | .12 | 4.1 | 40 |
| sec. butyl alcohol-2% | .0309 | .29 | 2.8 | 80 |
| sec. butyl alcohol-4%* | .0190 | .16 | 4.2 | 85 (5 min. after first addition) |
| sec. butyl alcohol-4%* | .0265 | .17 | 3.7 | 135 (55 min. after first addition) |
| ter. butyl alcohol-2% | .0236 | .05 | 5.6 | 5 |
| ter. butyl alcohol-2% | .0247 | .15 | 4.1 | 45 |

*Includes original 2% plus an additional 2% added after 80 minutes.

The above data show that the holding time between the introduction of the secondary butyl alcohol to the filter feed and the performance of the filtration operation has an effect upon the filtering resistance parameter, *k*. Within 80 minutes of the addition of the original 2 percent of secondary butyl alcohol, the effect of the alcohol increased to a peak and then declined, since the observed advantage of the additive is greater after 40 minutes than it is after either 1 or 80 minutes. Furthermore, after the addition of the second 2 percent of secondary butyl alcohol, the observed effect of the additive was greater after 5 minutes than after 55 minutes. A similar observation on the effect of time is apparent in the case of tertiary butyl alcohol. Referring again to the secondary butyl alcohol data, it is seen that although the effect of the addition of the first two percent of secondary butyl alcohol peaked and declined with age, and the effect of the second addition of secondary butyl alcohol similarly peaks and declines with age, the second peak advantageously occurs at a lower filtration resistance than the first peak. This shows that intermittent addition of the secondary butyl alcohol permits achievement of an enhanced advantage due to the additive. This observation is surprising in view of the data of Example 4 which show that the advantage of isopropanol addition declines as the quantity increases in a single injection. Since, in practice, the alcohol employed can be recycled, it is a considerable advantage of the present invention that a method is provided for enhancing the effect of the alcohol additive via increase of the amount of the alcohol employed. By employing recycle, the increased amount of alcohol used in the process has very little effect upon operating costs.

EXAMPLE 6

A series of tests was performed using isopropanol to further illustrate the effect of holding time between the addition of the isopropanol to the coal liquid and the filtration of the liquid. The tests were performed at 500° F. (260° C.) and with a pressure drop of 80 psi (5.6 Kg/cm$^2$). The results of these tests are shown in the following table.

| Additive and Concentration, Wgt. Percent | k, (g$^2$/min)$^{-1}$ | Rate, (g/min) | Elapsed time between addition of additive and filtration, min. |
|---|---|---|---|
| None | .0284 | 3.9 | — |
| Isopropanol, 2% | .0191 | 5.4 | 3 |
| Isopropanol, 2% | .0144 | 7.0 | 6 |
| Isopropanol, 2% | .0139 | 7.1 | 9 |
| None | .0464 | 2.4 | — |
| Isopropanol, 2% | .0209 | 3.4 | 35 |

The above data show an improved effect upon the filtration resistance parameter, *k*, resulting from an extended holding time between the addition of isopropanol and the filtration. These data tend to indicate the occurrence of a delayed reaction between the alcohol additive and material in the coal liquid.

EXAMPLE 7

Four filtering tests were performed to further illustrate the effect of the time interval between the introduction of isopropanol to the coal liquid and the filtering operation. In one test, isopropanol was not added. The coal liquid of the other three tests contained two weight percent isopropanol with holding times of two, four and six minutes, respectively. In all of the tests, the temperatures were about 500° F. (260° C.), and the pressure drop was 80 psi (5.6 Kg/cm$^2$). The results of these tests are shown in the figure. The times noted at the data points along each parameter curve are the elapsed times between the start of the filtering tests and the times at which the data point was obtained. As shown in the figure, the use of isopropanol reduced the filtration resistance in all cases. However, progressively lengthened holding times between the addition of the isopropanol and start of the filtration test resulted in progressively lower filtering resistances.

EXAMPLE 8

A series of filtering tests was performed to further illustrate the advantage of intermittent addition of alcohol. In all of these tests, isopropanol was added to an unfiltered liquid coal mixture held at a temperature between 110° and 130° F. (43° and 54° C.). The holding time between completion of alcohol addition and filtration was 5 minutes at a holding temperature of 500° F. (260° C.). The filtrations were performed at 500° F. (260° C.) with a pressure drop of 80 psi (5.6 Kg/cm$^2$). Following are the results of the tests.

| Additive and Concentration, Wgt. Percent | k, (min/g$^2$) | C, (min/g) | Rate, (g/min) |
|---|---|---|---|
| None | .0510 | .07 | 3.8 |
| Isopropanol-2% (added in a single increment) | .0239 | .09 | 4.9 |
| Isopropanol-4% (added in two increments with second 2% increment added 30 minutes after adding first 2% increment) | .0188 | .03 | 6.5 |
| Isopropanol-4% (added in a single increment) | .0218 | .05 | 5.7 |

The above data show that the addition of 4% of isopropanol in a single increment resulted in a slightly improved resistance parameter as compared to the addition of a single increment of 2% of isopropanol. However, the addition of 4% of isopropanol in two equal spaced increments resulted in a significant further improvement in the resistance parameter.

We claim:

1. In a process for removing ash from coal including a dissolving step wherein coal hydrocarbonaceous material is dissolved with a hydroaromatic solvent to produce an effluent stream comprising dissolved coal liquid, hydroaromatics and suspended ash-containing solids, and passing said effluent stream to a solids-liquid separation step, the improvement comprising adding to said effluent stream in advance of said solids-liquid separation step an aliphatic alcohol containing 2 to 10 carbon atoms which forms a homogeneous composition in said coal liquid.

2. The process of claim 1 wherein said solids-liquid separation step is a filtration step.

3. The process of claim 1 wherein said dissolving step is performed in the pesence of hydrogen and/or carbon monoxide.

4. The process of claim 1 wherein said alcohol is isopropanol.

5. The process of claim 1 wherein said alcohol is primary, secondary or tertiary butanol.

6. The process of claim 1 wherein said alcohol is present in said effluent stream in an amount between about 0.05 and 15 weight percent.

7. The process of claim 1 wherein said effluent stream contains at least 3 weight percent ash and at least 2 weight percent of hydroaromatics and said alcohol is added to the effluent stream while the temperature of the effluent stream is between 100° and 700° F.

8. The process of claim 1 including a holding time of 30 seconds to 3 hours between the alcohol addition step and the solids-liquid separation step.

9. In a process for removing ash from coal including a dissolving step wherein coal hydrocarbonaceous material is dissolved with a hydroaromatic solvent to produce an effluent stream comprising dissolved coal liquid, hydroaromatics and suspended ash-containing solids, and passing said effluent stream to a solids-liquid separation step, the improvement comprising adding separate increments of alcohol to said effluent stream in advance of said solids-liquid separation step with a time interval of 30 seconds to 3 hours between the addition of said increments, said alcohol comprising an aliphatic alcohol containing between 2 and 10 carbon atoms which forms a homogeneous composition within said coal liquid.

10. The process of claim 9 wherein said solids-liquid separation step is a filtration step.

11. The process of claim 9 wherein said time interval is between 1 minute and 1 hour.

12. The process of claim 9 wherein said time interval is between 5 minutes and 30 minutes.

13. The process of claim 9 wherein said alcohol is added to said effluent stream while the temperature of the stream is between 100° and 700° F. and said effluent stream contains at least 3 weight percent ash and at least 2 weight percent of hydroaromatics.

14. The process of claim 9 including a holding time of 30 seconds to 3 hours following addition of the final increment.

15. The process of claim 9 wherein said alcohol is isopropanol.

16. The process of claim 9 wherein said alcohol is primary, secondary or tertiary butyl alcohol.

17. The process of claim 9 wherein said dissolving step is performed in the presence of hydrogen and/or carbon monoxide and between 0.05 and 15 weight percent of alcohol is added to said effluent stream.

* * * * *